US005755554A

United States Patent [19]

Ryall

[11] Patent Number: 5,755,554

[45] Date of Patent: May 26, 1998

[54] MULTISTAGE PUMPS AND COMPRESSORS

[75] Inventor: Michael Leslie Ryall, Glasgow, United Kingdom

[73] Assignee: Weir Pumps Limited, Glasgow, Scotland

[21] Appl. No.: 769,453

[22] Filed: Dec. 18, 1996

[30] Foreign Application Priority Data

Dec. 22, 1995 [GB] United Kingdom ..... 9526369

[51] Int. Cl.[6] ..... F04D 29/44

[52] U.S. Cl. ..... 415/199.4; 415/199.5

[58] Field of Search ..... 415/198.1, 199.4, 415/199.5

[56] References Cited

U.S. PATENT DOCUMENTS

| | | | |
|---|---|---|---|
| 1,554,591 | 9/1925 | Oliver . | |
| 2,224,519 | 12/1940 | McIntyre | 415/220 |
| 2,505,755 | 5/1950 | Ganahl et al. | 415/220 |
| 2,749,027 | 6/1956 | Stalker . | |
| 3,433,163 | 3/1969 | Sheets et al. . | |
| 3,442,220 | 5/1969 | Mottram et al. . | |
| 4,029,438 | 6/1977 | Sloan . | |
| 4,080,096 | 3/1978 | Dawson . | |
| 4,830,584 | 5/1989 | Mohn . | |
| 5,222,864 | 6/1993 | Jones . | |
| 5,425,617 | 6/1995 | Teran . | |
| 5,511,942 | 4/1996 | Meier | 415/220 |
| 5,562,405 | 10/1996 | Ryall . | |

FOREIGN PATENT DOCUMENTS

| | | |
|---|---|---|
| 0080251 | 6/1983 | European Pat. Off. . |
| 0236166 | 9/1987 | European Pat. Off. . |
| 0475920 | 3/1992 | European Pat. Off. . |
| 2333139 | 11/1975 | France . |
| 512487 | 9/1939 | United Kingdom . |
| 515469 | 12/1939 | United Kingdom . |
| 644319 | 10/1950 | United Kingdom . |
| 676371 | 7/1952 | United Kingdom . |
| 692188 | 6/1953 | United Kingdom . |
| 743475 | 1/1956 | United Kingdom . |
| 766812 | 11/1957 | United Kingdom . |
| 1119756 | 7/1968 | United Kingdom . |
| 1471222 | 4/1977 | United Kingdom . |
| 2005349 | 7/1978 | United Kingdom . |
| 1561454 | 2/1980 | United Kingdom . |

OTHER PUBLICATIONS

"Poseidon Multiphase Technology" World Pumps, Aprl. 1993, No. 319 (pp. 16–17).

Compressors, Selection & Sizing, Royce N. Brown, 1986 (pp. 218–224).

Aero–Thermodynamics and Flow in Turbomachines, M.H. Vavra, (pp. 344–345).

Innovative Solutions for Multiphase Pumping, Martin Sigmundstad, 1988.

Theoretical Studies of Pump Performance in Two–Phase Flow, C.J. Homer, 1985, United Kingdom.

*Primary Examiner*—John T. Kwon

*Attorney, Agent, or Firm*—Young & Basile, P.C.

[57] ABSTRACT

A multistage pump or compressor includes a series of axial flow stages. Each stage comprises an impeller for imparting whirl to the pumped fluid in one direction and a stator including vanes for imparting whirl to the pumped fluid in the opposite direction. The stator vanes define flow passages configured such that the fluid flows through the passages at substantially constant absolute velocity. The average ratio of stage axial length to impeller diameter for each axial flow stage is less than 0.4.

26 Claims, 3 Drawing Sheets

MULTISTAGE PUMPS AND COMPRESSORS

FIELD OF THE INVENTION

This invention relates to multistage pumps and compressors, and in particular but not exclusively to pumps capable of pumping liquid to high pressures and compressors for the high pressure compression of gasses, and mixtures of gasses and liquids.

BACKGROUND OF THE INVENTION

For nearly a century it has been widely accepted that, in order to raise large volumes of liquid to high pressures, a pump utilising a plurality of centrifugal stages, arranged in series, is required. Accordingly, all large, high pressure pumping installations are of this type, including, for example: boiler feed pumps in steam driven electric power generating stations; pipeline pumps for water and oil; and water injection pumps for secondary recovery of hydrocarbons from subsurface reservoirs.

Centrifugal pump stages operate by the rotating impeller blades imparting rotational energy to the liquid, which increases the velocity and pressure of the liquid. The blades rotate between impeller shrouds and liquid with a high whirl component of velocity is discharged by the impeller into a diffuser or volute casing, which serves to reduce the velocity of the liquid and convert the velocity energy into pressure energy, thus further increasing the pressure of the liquid. The liquid is ducted through vaned return passages inwardly towards the pump shaft, reducing the whirl component of velocity such that the liquid enters the eye of the second stage impeller substantially without whirl. The second stage impeller and diffuser or volute repeat the process as described above, with the pressure of the liquid increasing as it passes through this and subsequent pump stages.

The centrifugal impellers and adjacent liquid return passages are axially separated by stage pieces and diaphragms, each of which form integral, stationary parts of a stage ring section. The stage ring sections may be bolted together to form an integral pressure casing for the pump.

From the above description it will be noted that the passage of liquid through a multistage centrifugal pump is tortuous, the liquid first being impelled to the outer part of the pressure casing interior and then passing, via the return guide passages, to the inner part of the casing adjacent the shaft. The necessity, with this arrangement of pump, to accelerate the liquid in each impeller and turn it through large angles in the diffusers or volutes and inward return passages, inevitably involves energy losses. Furthermore, additional internal energy losses are created in the pump from the hydrodynamic friction between the outer surfaces of the impeller shrouds and the adjacent stationary diaphragm walls.

For higher pressure applications with, necessarily, a large number of stages, the shaft length/diameter ratio becomes large, leading to high shaft flexibility and the risk of contact between rotating and stationary components at the fine clearance internal impeller wear rings and shaft seals, resulting in fall-off in performance and risk of seizure. The risk is accentuated by the comparatively large masses of impellers on the shaft, and the high fluctuating hydrodynamic radial forces generated by centrifugal impellers due to rotating stall and other effects, particularly at liquid flows which are a low percentage of the best efficiency flow rate.

Many of the hydraulic components of multistage centrifugal pumps are produced as complex three-dimensional castings, involving a high tooling piece part cost. The comparatively large diameters required to generate pressure by a centrifugal field, and the passage lengths required for efficient diffusion, are further factors which lead to high cost, particularly when the pressure contained within the pump is high.

It is among the objects of the embodiments of the various aspects of the present invention to provide a multistage pump which minimises the flow path of the fluid through the pump to reduce manufacturing cost, and to minimise the hydraulic friction losses created during the pumping process, thereby improving the efficiency of the conversion of mechanical energy to hydraulic energy within the pump. Further, the objects of embodiments of the aspects of the present invention include provision of a multistage pump which is simpler, more robust, easier to maintain and more environmentally acceptable than conventional pumps of comparable performance. The present invention is an improvement of the pump described in U.S. Pat. No 5,562,405, the disclosure of which is incorporated herein by reference.

SUMMARY OF THE INVENTION

According to the present invention there is provided a multistage pump or compressor comprising a series of axial flow stages, each stage comprising an impeller for imparting whirl to the pumped fluid in one direction and a stator including vanes for imparting whirl to the pumped fluid in the opposite direction, the flow passages between the stator vanes being configured such that, at or near the flowrate at which stage efficiency is a maximum, the fluid flows therethrough at substantially constant absolute velocity, and the average ratio of stage axial length to impeller diameter for each axial flow stage being less than 0.4.

As used herein, the terms "pump" and "compressor" are to be considered as interchangeable, where the context permits. Further, references to the pump characteristics and performance will generally refer to conditions prevalent at or near the design duty of the pump, that is the flowrate at which the pump efficiency is a maximum.

Preferably, the average ratio of stage axial length to impeller diameter for each axial flow stage is less than 0.3, and most preferably between 0.2 and 0.25.

Preferably also, the average stage head co-efficient $$\psi\left(=\frac{gH}{U_T^2}\right)$$

has a value greater than 0.3 at the best efficiency flow of the pump, where:

H=stage generated head (for compressors, polytropic stage head)

$U_T$=tip velocity of impeller g=gravitational constant (9.81 m/s).

Preferably also, each axial flow impeller has a hub and blades mounted on the hub and defining tips, and the mean hub\tip diameter ratio of each axial flow impeller is greater than 0.7.

Preferably also, each impeller has an inlet flow coefficient $$\left(\phi=\frac{v_a}{U_T}\right)$$

with a value of less than 0.4, preferably less than 0.3, and most preferably a value between 0.15 and 0.25, where:

$v_a$=fluid axial velocity component at impeller inlet $U_T$=impeller tip velocity.

Preferably also, each axial flow impeller has a relatively large number of blades, preferably more than five and typically between six and 15 blades.

Preferably also, the impeller of each axial stage has blades defining a tip diameter and the pitch/chord ratio at the tip diameter is less than 0.8.

Preferably also, in the stator of each axial stage, the stator vanes are arranged to change the direction of absolute flow velocity of the fluid by between 80° and 120°, such that, at or near the flowrate at which the stage efficiency is a maximum, the whirl component of the fluid velocity leaving the stator is approximately the same as the whirl component of the fluid as it enters the stator vanes, but in the opposite direction.

Preferably also, at the design duty or flowrate, the absolute fluid velocity is maintained substantially constant through the impeller and stator of each stage. Most typically, the absolute fluid velocity is one third of the maximum fluid velocity in an equivalent centrifugal pump operating at the same rotational speed. These low velocities result in the sound power levels generated by the pump being much lower than in conventional centrifugal pumps.

Preferably also, each axial flow stator has a relatively large number of impulse-type blades, preferably more that 30 blades and typically between 40 and 100 blades, of small axial chord length, typically less than 15% and preferably between 5 and 10% of the tip diameter of the stator blades.

Preferably also, the impellers are mounted on a shaft and, in use, each experiences an axial thrust, and the cumulative axial thrust is at least partially balanced by one of a balance drum and balance disc mounted on the impeller mounting shaft.

Preferably also, at least a first pump stage is arranged to accommodate the nett positive suction head (NPSH) characteristics of the system in which the pump is intended to operate. To this end, the first pump stage may be of the centrifugal, mixed or axial flow type.

Preferably also, the axial clearance between the impellers and the stators is maintained by limiting the axial movement of the pump shaft by a thrust bearing. The bearing may be of the hydrostatic type and lubricated with fluid from high pressure regions of the pump. Alternatively, the bearing may be of the external, oil lubricated type.

Preferably also, the pump shaft is radially supported by bearings lubricated with fluid from high pressure regions in the pump, so that the bearings are substantially hydrostatic with a high radial stiffness.

Preferably also, the stators are radially located and housed within an accurately bored tube or barrel. The stators may be prevented from rotating by keys or dowels or by axial clamping from the ends of the stator stack. The impeller rotors may be keyed to the pump shaft, or axially clamped together by nuts at each end of the shaft.

The hub profile for both the stators and rotors may be cylindrical, however for certain applications, such as gas compression a conical hub profile for the hubs of both the impellers and the stators may be utilised.

In gas compression applications, the impellers located towards the lower pressure end of the compressor may provide higher flow coefficients, to maximise gas "swallowing capacity" at inlet. Further, for use in gas compression applications, the impeller and stator blade heights may be progressively reduced in consecutive stages or groups of stages, to cater for the compressibility of the gas.

BRIEF DESCRIPTION OF THE DRAWINGS

This and other aspects of the present invention will now be described, by way of example, with reference to the accompanying drawings, in which.

DETAILED DESCRIPTION OF DRAWINGS

Figure 1:
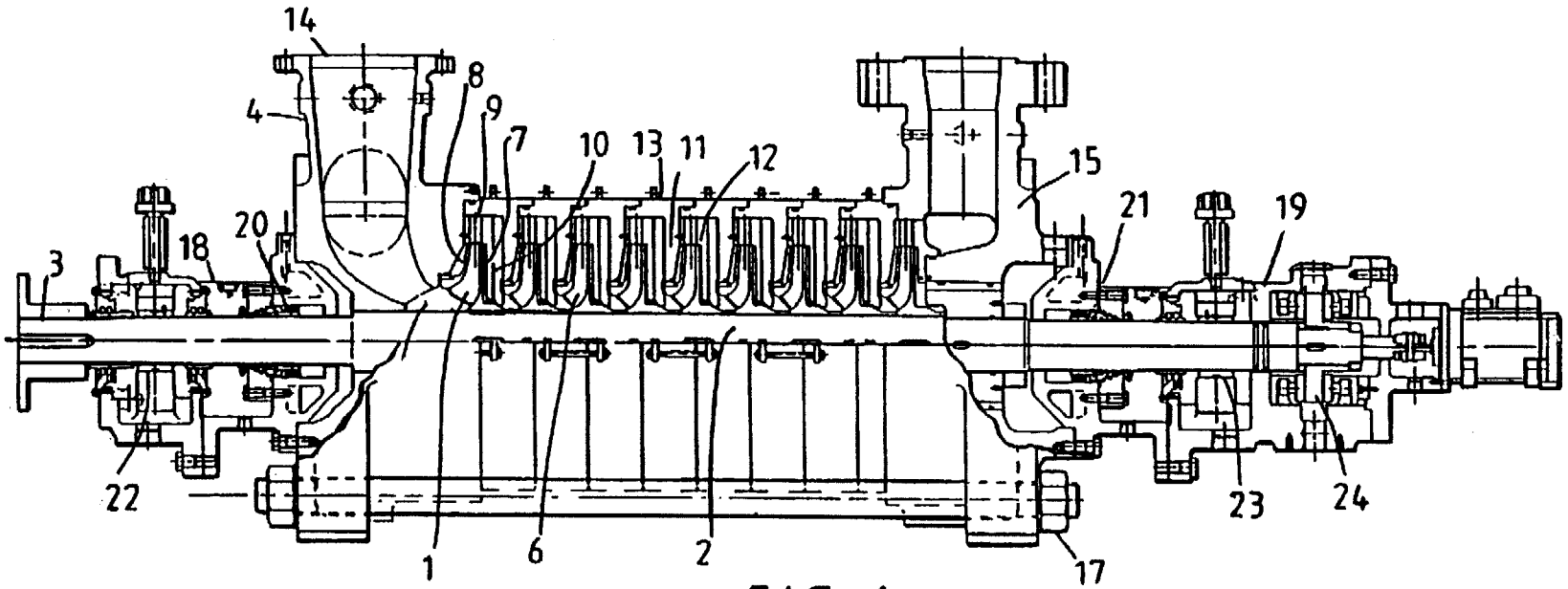
FIG. 1 is a sectional view of a multistage centrifugal pump, in accordance with the prior art.

Reference is first made to FIG. 1 of the drawings, which illustrates a conventional multistage centrifugal pump as might be used, for example, as a boiler feed pump in a steam driven electric power generating station. In this pump, a series of centrifugal impellers 1 is mounted on a rotating shaft 2, driven through a coupling 3 by an appropriate prime mover or electric motor (not shown).

Liquid enters the pump via an inlet branch 4 to an eye 5 of the first stage centrifugal impeller 1, adjacent to the shaft 2. The impeller imparts rotational energy to the liquid, increasing its velocity and pressure in the process, by means of blades 6 mounted between a back shroud 7 and a front shroud 8 of the impeller. Liquid with a high whirl component of velocity is then discharged by the impeller into a diffuser 9 with a plurality of blades. The diffuser 9 serves to reduce the velocity of the liquid and convert the velocity energy into pressure energy, further increasing the pressure of the liquid.

From the outer extremities of the diffuser 9 the liquid is then ducted through vaned return passages 10 inwardly towards the shaft 2, further reducing the whirl component of velocity, such that the liquid enters the eye of the second stage impeller substantially without whirl. The impellers and diffusers of the subsequent stages repeat the process as described above, the pressure of the liquid being increased as the liquid passes through the nine stages of the pump.

The centrifugal impellers 1 and adjacent liquid return passages 10 are axially separated by stage pieces 11 and diaphragms 12, each of which form integral, stationary parts of stage ring sections 13. In the pump construction as illustrated in FIG. 1, the ring sections 13, together with a suction casing 14 and a discharge casing 15, are bolted together by tie-bolts 17 to form a integral pressure casing for the pump.

At each end of the pump, attached rigidly to the suction casing 14 and the discharge casing 15, are bearing and seal housings 18 and 19, containing seals 20, 21, oil lubricated journal bearings 22, 23, and a tilting pad oil lubricated thrust bearing 24.

The basic stage components described above are also widely used in other constructions having modified assembly arrangements, for example, the stages may all be contained in a single barrel casing to provide improved pump rigidity and pressure integrity; and vertical, rather than horizontal arrangements for the axis of rotation of the pump are often preferred.

Figure 2:
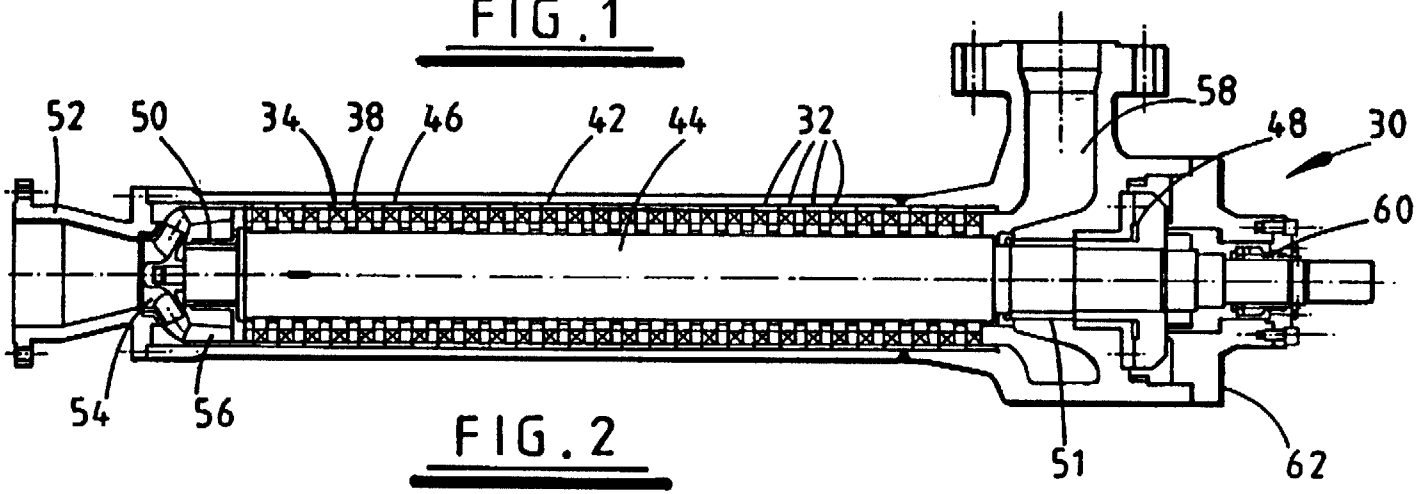
FIG. 2 is a sectional view of a multistage axial pump in accordance with a preferred embodiment of the present invention.

Reference is now made to FIG. 2 of the drawings, which illustrates a multistage axial pump 30 in accordance with a preferred embodiment of the present invention. To facilitate comparison with pump described above with reference to FIG. 1, the illustrated pump 30 has the same duty pumping head, the same duty flowrate and the same rotational speed as the conventional centrifugal pump as shown in FIG. 1 (300 $m^3$/h@1500 m and 2980 rpm), and has been drawn to the same scale.

Figure 3:
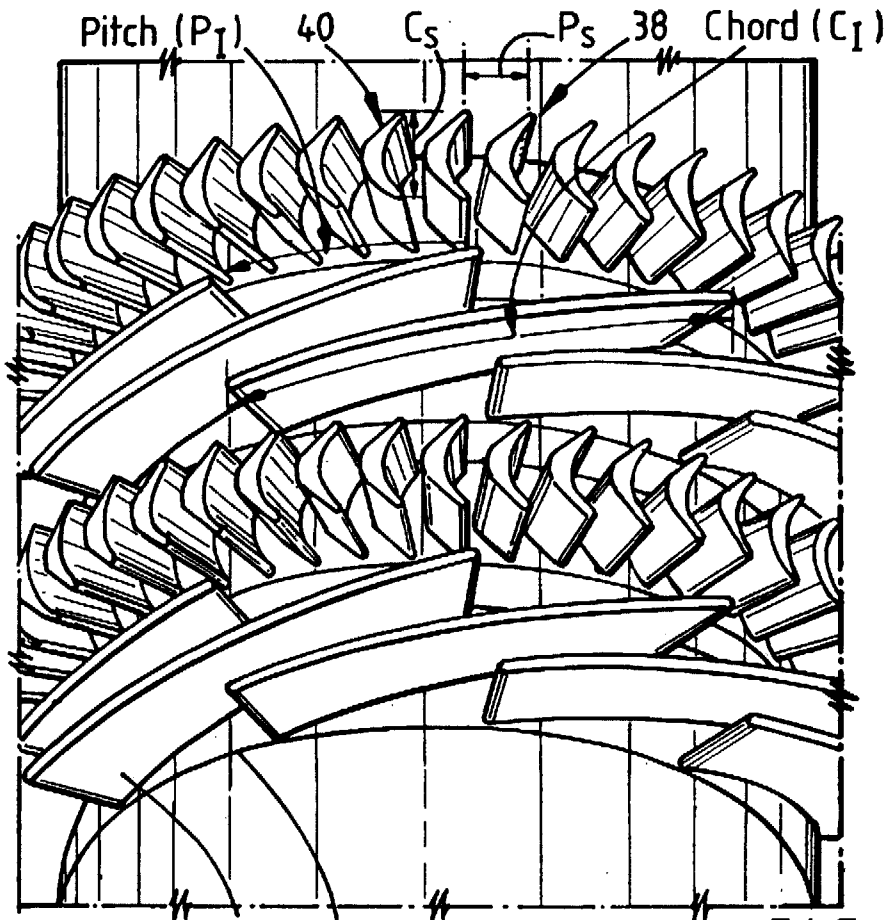
FIG. 3 is a perspective view (to an enlarged scale) of two stages of the pump of FIG. 2.

The pump 30 comprises a series of twenty-eight axial flow stages 32, and details of two of the stages are illustrated in FIG. 3 of the drawings and will be described in detail following a general description of the overall pump configuration.

The stators are radially located and housed within an accurately bored barrel 42, and prevented from rotating by appropriate keys or dowels (not shown). Similarly, the impeller rotors are keyed to shaft 44. The rotors are machined to an outer diameter such that they rotate inside the precision machined bores of the stator spacer rings 46 with a small clearance. In this embodiment the hub profile of both rotors and stators is cylindrical.

A small axial clearance is maintained at all times between successive impeller rotors and stators by means of a hydrostatic thrust bearing and balance disc 48 and in this embodiment the rotating shaft assembly is radially supported within bearings 50, 51, all of the bearings 48, 50, 51 being lubricated by the pumped fluid. The supply of fluid to the bearings 50, 51 is from the high pressure regions of the pump, so that the bearings are essentially hydrostatic with a large radial stiffness, ensuring dynamic radial stability of the rotating shaft assembly at all times.

Fluid enters the pump axially via an inlet branch 52 to a mixed flow first stage impeller 54 which discharges through a diffuser 56, to the second stage, that is the first axial stage. The incorporation of a mixed flow impeller into the pump at the first stage with a small inlet eye ensures that NPSH requirements for the avoidance of cavitation are met.

High pressure fluid is discharged from the pump via a discharge branch 58. At the drive end of the pump (in this example the right hand end), a mechanical seal 60 contains the fluid within the pump. This seal is mounted within a pump end cover 62.

The axial flow stages 32 will now be described in detail, with reference to FIG. 3 of the drawings.

Each axial stage impeller 34 includes eleven impeller rotor blades 36 having an inlet flow co-efficient $$\frac{va}{U_T} = \phi$$

with a value of 0.22, and the pitch\chord ($P_l$\$C_l$) ratio of the blades 36 is 0.5.

Each impeller 34 discharges into a bladed stator 38 provided with forty eight blades 40 of impulse blade cross-section. Accordingly, the stator vanes 40 simply change the direction of flow of the fluid, at substantially constant absolute velocity, from a direction with a whirl component in the same direction as that of the rotating impeller rotor blades 36, to a direction with a whirl component in the opposite direction of the impeller rotor blades 36. In this particular example the stator vanes change the direction of absolute flow velocity of the fluid by approximately 90°, the whirl component of the fluid velocity leaving the stator vanes 40 being approximately the same as that entering the stator rotor blades 36, but in the opposite direction.

The ratio of circumferential pitch $P_s$ to stator blade axial chord length $C_s$ is 0.5, and the hub diameter\tip diameter of both impellers and stators is 0.78. The axial chord length $C_s$ is 8% of the tip diameter of the stator blades.

The average stage head co-efficient ($\psi$) of the pump at the design duty or best efficiency flow of the pump 30 is 0.34.

It will be observed from FIGS. 1 and 2, which are drawn to the same scale, that while the axial flow pump made in accordance with an embodiment of the present invention has approximately three times as many stages to develop the same head as the centrifugal pump shown in FIG. 1, each axial flow pump stage occupies a shorter length than a centrifugal stage, and also that the axial flow stages are of smaller diameter than the centrifugal stages (typically 30–40% smaller). The relatively short stage length is achieved by the use of relatively large numbers of rotor blades with a low inlet flow co-efficient, together with the use of a large number of impulse blades to form the stator vanes 40 with a small blade axial chord $C_s$ (FIG. 3). In effect, the stator vanes 40 act as cascade bends, which is an inherently efficient method of flow turning, occupying much less axial length than would be required for an axial diffuser.

It will be apparent to those of skill in the art that the passage of fluid through the axial flow pump 30 is much shorter and less tortuous than the flow path in a multistage centrifugal pump designed for the same duty, as shown in FIG. 1. Partly for this reason, and partly because the frictional loss between centrifugal impeller shrouds at the adjacent stationary diagrams is eliminated in the axial flow pump, fluid friction losses are reduced. This results in an overall pump efficiency which is several percentage points higher than is practically obtained with a multistage centrifugal pump; in the illustrated pumps, the power input for the centrifugal pump was 1631 kW, giving an overall efficiency 75%, while the pump 30 only required a power input of 1568 kW, giving an overall efficiency of 78%, an energy saving of 63 kW.

A further contribution towards a reduction in hydrodynamic energy losses in the pump 30 is the fact that, at the design duty, the absolute fluid velocity is not increased and decreased as the fluid passes through each stage (an inefficient process inherent in multistage centrifugal pumps and compressors, and in axial flow compressors with reaction blading) but is maintained substantially constant, at a value which is typically one-third the maximum absolute velocity in an equivalent centrifugal pump, throughout the passage of the fluid through the axial stages; the impelling action at the design flowrate of the impeller rotor 36 and the impulse blade stator vanes 40 simply changes the absolute direction of the fluid at constant velocity, with increases in fluid pressure almost all occurring in successive rotor blade passages.

Figure 4:
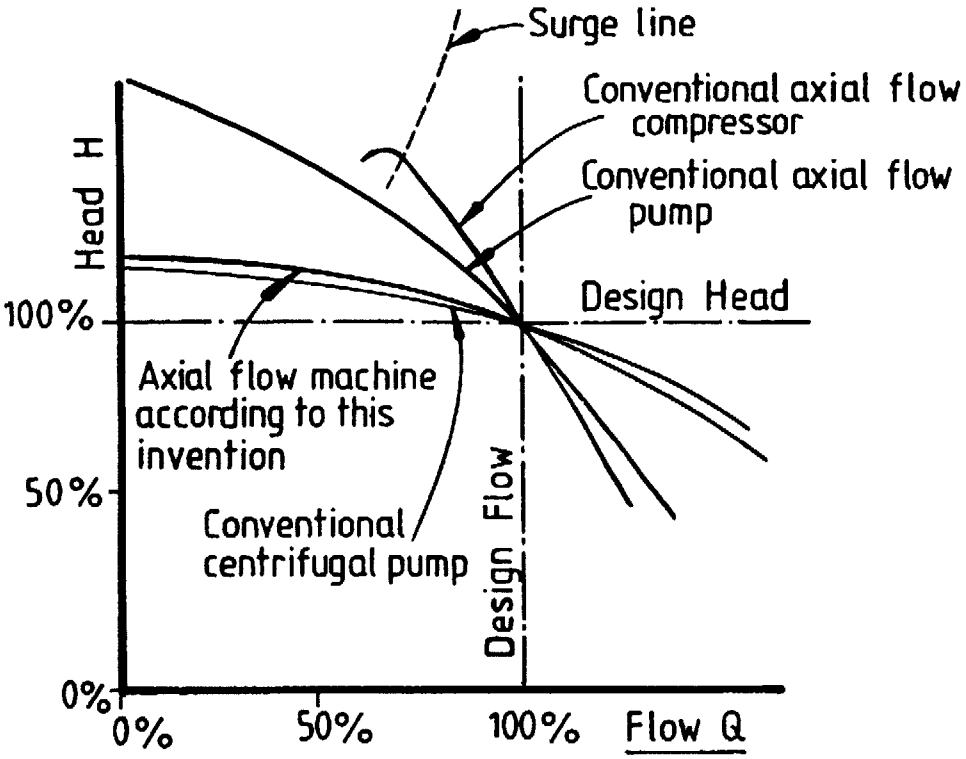
FIG. 4 is a graph of Head (H) v Flowrate (Q) showing typical curves representative of the performance of the axial flow pump of FIG. 2, a conventional centrifugal pump as shown in FIG. 1, a conventional axial flow pump, and a conventional axial flow compressor.

An important feature of the novel rotor\stator blading combination according to the preferred embodiments of this invention is the comparatively flat Head\Flow characteristic, as is shown in FIG. 4, similar to that of a centrifugal pump. As shown in FIG. 4, conventional axial flow pumps, with diffusing stator blades, have a comparatively steep Head\Flow curve, resulting in a high generated pressure at low flowrates. The latter is disadvantageous, as it results in the downstream pressure rating of the pipework system being high, with penalties on cost. Conventional axial flow compressors also have much steeper Head\Flow characteristics, and a much narrower flow range for stable operation than axial flow machine made in accordance with the invention, as can be seen in FIG. 4.

It will also be apparent to those of skill in the art that the pump 30 is much more compact, lighter and simpler in construction than the conventional centrifugal pump illustrated in FIG. 1. Typically, a pump made in accordance with the present invention will be between 25% and 40% of the weight of a corresponding multistage centrifugal pump, with simpler patterns and tooling on account of the avoidance of complex three-dimensional passage shapes; in the illustrated examples, the centrifugal pump illustrated in FIG. 1 has a weight of 3.6 tons, while the pump 30 has a weight of 1.35 tons. Accordingly, major reductions in manufacturing costs are achievable.

As will also be apparent from a comparison of the pumps of FIGS. 1 and 2, the rotating assembly of the axial flow pump 30 is very much stiffer than in FIG. 1, because of the larger diameter shaft realisable with the axial flow machine, and the shorter span between bearings resulting from the adoption of fluid lubricated journal bearings 50, 51. This additional stiffness results in a much lower risk of wear and seizure from internal rubbing.

Pressure integrity is also enhanced in the pump 30, due to its barrel casing construction and reduced number of external joints. A barrel case version of the pump shown in FIG. 1 would be around four times the weight of the equivalent barrel case axial pump 30.

Clearly, the reduced space and weight inherent in the axial flow pump 30 facilitates installation, transport, assembly and maintenance, for example the pump 30 may easily be arranged vertically, driven from above, and possibly suspended from a floor near the drive end.

A further advantage of the multistage axial pump 30 over conventional centrifugal pumps, stems from the comparatively low tip velocity of the impellers 34, and the low absolute flow velocities. These low velocities result in the sound power levels generated by the pump 30 being much lower than in conventional centrifugal pumps.

It will be recognised by those skilled in the art that it is important in the design of axial flow pumps and compressors as described herein that the axial space occupied by the rotors and stators must be kept as short as possible, since more stages are required to generate a given head with a multistage axial flow machine than with a multistage centrifugal machine at the same rotational speed. In the preferred embodiments of the invention, this is achieved by the adoption of a comparatively large number of impeller rotor blades (generally between 6 and 15), and an even larger number of stator blades (generally between 40 and 100). The actual number of blades adopted will be determined from hydraulic and mechanical design considerations.

It will also be clear to those of skill in the art that the above-described pump 30 is merely exemplary of the present invention, and that various modifications and improvements may be made thereto without departing from the scope of the invention, and a number of possible modifications will be described below.

The pump 30 is provided with bearings lubricated by the pumped fluid, however it is also possible to construct the pump with one or two oil lubricated journal bearings and oil lubricated thrust bearings. Further, it is possible to provide the pump with a radial flow inlet through an inlet branch, similar to the branch 4 as illustrated in FIG. 1 of the drawings.

Of course pumps made in accordance with the present invention may also be designed to operate at high rotational speeds, especially for larger power pumps in excess of about 2 megawatts input power.

For the compression of gasses, or mixtures of liquids and gasses, the geometry of the blading of both of the impeller rotors and the stators is substantially as described above with the additional consideration that, depending on the pressure ratio across the machine, the annular cross-sectional area of the bladed passages in the machine at right angles to the axis of rotation will generally be reduced as the fluid passes through the machine, by a reduction in blade radial heights and an increase in hub diameter\tip diameter ratio progressively or in steps from the first axial flow stage to the last stage. Smaller blade hub\tip ratios than those shown in FIG. 2 may be used for gas compression, as bending loads are lower on the blades. It may also be desirable in gas compression versions of the pump to design for higher flow co-efficients at the inlet end of the machine than at the high pressure end, to maximise gas "swallowing capacity" at inlet. Gas compression versions of the axial flow machine in accordance with present invention will of course not require a mixed flow impeller first stage, since cavitation cannot occur with gasses. Depending on the gas density at entry to the compressor, a larger number of thinner blades, spaced circumferentially to give similar pitch\chord ratios, may be adapted with a shorter chord length, to give a shorter stage length than is practicable with liquids. Compressor rotational speeds will in general be three or four times those for liquid pumps, and the maximum number of compressor stages will not generally exceed twenty. The radial and axial thrust bearings of gas compressors will generally be mounted externally, and lubricated with oil.

I claim:

1. A multistage pump for pumping fluid, the pump including a series of axial flow stages, each stage comprising an impeller for imparting whirl to the pumped fluid in one direction and a stator including vanes for imparting whirl to the pumped fluid in the opposite direction, the stator vanes defining flow passages configured such that, at or near the flowrate at which stage efficiency is a maximum, the fluid flows therethrough at substantially constant absolute velocity, and the average ratio of stage axial length to impeller diameter for each axial flow stage being less than 0.4.

2. The pump of claim 1, wherein the average ratio of stage axial length to impeller diameter for each axial flow stage is less than 0.3.

3. The pump of claim 2, wherein the average ratio of stage axial length to impeller diameter for each axial flow stage is between 0.2 and 0.25.

4. The pump of claim 1, wherein the average stage head coefficient $$\psi\left(=\frac{gH}{U_T^2}\right)$$

has a value greater than 0.3 at the best efficiency flow of the pump.

5. The pump of claim 1, wherein each axial flow impeller has a hub and blades mounted on the hub and defining tips, and the mean hub\tip diameter ratio of each axial flow impeller is greater than 0.7.

6. The pump of claim 1, wherein each impeller has an inlet flow co-efficient $$\left(\phi=\frac{v_a}{U_T}\right)$$

with a value of less than 0.4.

7. The pump of claim 6, wherein each impeller has an inlet flow co-efficient with a value of between 0.15 and 0.25.

8. The pump of claim 1, wherein each axial flow impeller has more than five blades.

9. The pump of claim 1, wherein the impeller of each axial stage has blades defining a tip diameter, and the blade pitch/chord ratio at the tip diameter is less than 0.8.

10. The pump of claim 1, wherein, in the stator of each axial stage, the stator vanes are arranged to change the direction of absolute flow velocity of the fluid by between 80° and 120°, such that, at or near the flowrate at which the stage efficiency is a maximum, the whirl component of the fluid velocity leaving the stator is approximately the same as the whirl component of the fluid as it enters the stator vanes, but in the opposite direction.

11. The pump of claim 1, wherein each axial flow stator has impulse-type blades.

12. The pump of claim 1, wherein each axial flow stator has more than 30 blades.

13. The pump of claim 1, wherein each axial flow stator has blades of small axial chord length and less than 15% of the tip diameter of the stator blades.

14. The pump of claim 1, wherein each axial flow stator has more than thirty impulse-type blades, the blades being of small axial chord length and less than 15% of the tip diameter of the stator blades.

15. The pump of claim 1, wherein the impellers are mounted on a shaft and the cumulative axial thrust is at least partially balanced by one of a balance drum and balance disc mounted on the impeller mounting shaft.

16. The pump of claim 1, wherein the first pump stage is selected from one of a centrifugal, mixed and axial flow type.

17. The pump of claim 1, wherein axial clearance between the impellers and the stators is maintained by limiting the axial movement of an impeller mounting pump shaft by a thrust bearing.

18. The pump of claim 17, wherein the thrust bearing is selected from one of a hydrostatic type lubricated with fluid from high pressure regions of the pump, and an external, oil lubricated type.

19. The pump of claim 1, wherein the pump has a shaft radially supported by bearings lubricated with fluid from high pressure regions in the pump, so that the bearings are substantially hydrostatic with a high radial stiffness.

20. The pump of claim 1, wherein the stators are radially located and housed within a bored tube.

21. The pump of claim 20, wherein the stators are secured to the tube by keys.

22. The pump of claim 1, wherein the stators are held against rotation by axial clamping from the ends of the stator stack.

23. The pump of claim 22, wherein the impellers are axially clamped together by securing members at each end of an impeller mounting pump shaft.

24. The pump of claim 1, wherein the stators and impellers are mounted on hubs and the hub profile for both the stators and rotors is cylindrical.

25. The pump of claim 1, wherein the stators and impellers are mounted on hubs and the hub profile for both the stators and rotors is conical.

26. The pump of claim 1, where the impeller and stator blade heights are progressively reduced in consecutive stages or groups of stages.

* * * * *